US006147575A

United States Patent [19]

Hiratsuka et al.

[11] Patent Number: 6,147,575

[45] Date of Patent: Nov. 14, 2000

[54] DIELECTRIC FILTER TRANSMISSION-RECEPTION SHARING UNIT AND COMMUNICATION DEVICE

[75] Inventors: Toshiro Hiratsuka, Kusatsu; Tomiya Sonoda, Muko; Kenichii Iio, Nagaokakyo, all of Japan

[73] Assignee: Murata Manufacturing Co., Ltd., Japan

[21] Appl. No.: 09/302,149

[22] Filed: Apr. 29, 1999

[30] Foreign Application Priority Data

Apr. 30, 1998 [JP] Japan ..... 10-120690

[51] Int. Cl.[7] ..... H01P 1/20; H01P 7/10; H01P 5/12

[52] U.S. Cl. ..... 333/202; 333/219.1; 333/134

[58] Field of Search ..... 333/202, 204, 333/219.1, 134, 135

[56] References Cited

U.S. PATENT DOCUMENTS

| | | | |
|---|---|---|---|
| 5,786,740 | 7/1998 | Ishikawa et al. | 333/219.1 |
| 5,914,296 | 6/1999 | Shen | 333/235 |
| 5,945,894 | 8/1999 | Ishikawa et al. | 333/219.1 |
| 5,986,527 | 11/1999 | Ishikawa et al. | 333/239 |
| 6,016,090 | 1/2000 | Iio et al. | 333/202 |
| 6,052,087 | 4/2000 | Ishikawa et al. | 333/202 |

FOREIGN PATENT DOCUMENTS

| | | |
|---|---|---|
| 0520699 | 12/1992 | European Pat. Off. . |
| 0734088 | 9/1996 | European Pat. Off. . |
| 9324968 | 12/1993 | WIPO . |

*Primary Examiner*—Robert Pascal
*Assistant Examiner*—Patricia T. Nguyen
*Attorney, Agent, or Firm*—Ostrolenk, Faber, Gerb & Soffen, LLP

[57] ABSTRACT

A dielectric filter, a transmission-reception shared unit, and a communication device, which incorporate the filter, are disclosed; spurious modes among resonant modes of dielectric resonators formed on parts of a dielectric plate can be suppressed so as to improve attenuation characteristics. In the dielectric filter, an electrode having electrodeless parts is formed on both main surfaces of a dielectric plate so as to form dielectric resonators; and linear conductors as probes are formed on the upper surface of the dielectric plate, in which one of the linear conductors is coupled with the dielectric resonator so as to form a band elimination filter circuit and a low-band pass filter circuit is formed at a particular position on the other linear conductor. These band elimination filter circuit and low-band pass filter circuit allow signals of spurious modes to be cut off.

7 Claims, 9 Drawing Sheets

DIELECTRIC FILTER TRANSMISSION-RECEPTION SHARING UNIT AND COMMUNICATION DEVICE

BACKGROUND OF THE INVENTION

1. Field of the Invention

The present invention relates to a dielectric filter, a transmission-reception sharing unit, and a communication device for use in the microwave band and the millimeter-wave band.

2. Description of the Related Art

In order to achieve next-generation mobile and multimedia communications, ultra-fast transmission of a large amount of data is necessary. The millimeter-wave band having a wide bandwidth is suitable for this purpose. In addition, as another technology that can advantageously utilize the characteristics of the millimeter-wave band there is introduced collision-avoidance vehicle radar. Such millimeter-wave radar is greatly anticipated to improve safety in fog or snow. This is lacking in conventional laser radar using light.

When a conventional circuit structure mainly composed of microstrip lines is used in the millimeter-wave band, loss increases due to reduction of Q. A conventional $TE_{01\delta}$ dielectric resonator, which is widely used, leaks a large amount of resonant energy out of the resonator. Thus, in the millimeter-wave band in which relative dimensions of the resonator and the circuit are small, the resonator undesirably couples with a line, thereby leading to difficulty in design and characteristic reproduction.

In order to overcome these problems, a millimeter-wave band module using the technology of PDIC™, which is a Planer Dielectric Integrated Circuit, may be mentioned. An example of a dielectric resonator incorporated in the module is shown in Japanese Unexamined Patent Application Publication No. 8-265015, the contents of which are included herein for reference.

In the above-mentioned dielectric resonator, electrodes formed on both main surfaces of a dielectric plate have openings in which the surfaces of the dielectric plate are exposed. The openings oppose to each other, so that the dielectric plate between the openings may act as a dielectric resonator.

FIGS. 7A, 7B, and 7C show an example of a dielectric filter using a plurality of resonators. FIG. 7A shows a view in which the upper conductor part of the dielectric filter is removed; FIG. 7B shows a sectional view taken along the line A—A in FIG. 7A; and FIG. 7C shows a sectional view taken along the line B—B in FIG. 7A. In this figure, reference numeral 3 denotes a dielectric plate; on a first main surface of which an electrode 1 is formed having electrodeless parts 4*a* and 4*b*; and on a second main surface of the plate, an electrode 2 is formed having electrodeless parts 5*a* and 5*b* opposing the electrodeless parts 4*a* and 4*b*. Parts of the dielectric plate positioned between these electrodeless parts operate as TE010-mode dielectric resonators. Coaxial connectors 10 and 11 are formed in a cavity 8, and probes 6 and 7 are protruded from the respective central conductors thereof so as to respectively couple with the dielectric resonator.

In the dielectric filter shown in FIGS. 7A, 7B, and 7C, spurious responses result in problems, as described below.

FIG. 8 shows attenuation characteristics of the dielectric filter shown in FIGS. 7A, 7B, and 7*c*. Responses of each mode are shown: reference character (a) indicates HE110 mode; reference character (b) indicates HE210 mode; reference character (c) indicates HE310 mode; reference character (d) indicates TE110 mode; and reference character (e) indicates TE010 mode. In addition to responses of the TE010 mode, which is a main mode, a number of unnecessary spurious responses occur. When these spurious responses coincide with frequencies in which specified attenuation levels are necessary, they may not satisfy required attenuation levels.

FIGS. 9A to 9E shows examples of electromagnetic field distributions of the above-indicated respective resonant modes. In these figures, solid lines indicate electric field, and broken lines indicate magnetic field. In each of the figures, the upper part shows a plan view of a dielectric resonator, and the lower part shows a view from the sectional direction of the dielectric plate.

FIGS. 9A to 9E show coupling states in each mode between two adjacent dielectric resonators. In any of the modes, magnetic-field coupling occurs between the adjacent dielectric resonators at the mutually near part.

SUMMARY OF THE INVENTION

The present invention provides a dielectric filter, a transmission-reception sharing unit, and a communication device, incorporating the dielectric filter, in which spurious modes are suppressed.

According to one aspect of the present invention, there is provided a dielectric filter including a dielectric plate; a first electrode formed on a first main surface of the dielectric plate, the first electrode having a first opening; a second electrode formed on a second main surface of the dielectric plate, the second electrode having an another opening opposing the first opening; and a signal input unit and a signal output unit; wherein the signal input unit and the signal output unit are disposed for coupling with the dielectric resonators to input and output signals; and wherein at least either one of the signal input unit and the signal output unit is formed on the dielectric plate as a linear conductor for coupling with the dielectric resonators and for forming a lower frequency band pass filter circuit.

This structure permits attenuation of the high-frequency elements by the lower frequency band pass filter circuit of the linear conductor, which is the signal input unit or the signal output unit coupled with the dielectric resonator. Thus, when the block frequency of the lower frequency band pass filter circuit is set to a frequency substantially equal to the resonant frequency of TE010 mode, etc., which is a main mode, or it is set to a higher frequency than that of the main mode, spurious responses which occur on the side of higher-frequency band than the resonant frequency of the main mode can be suppressed.

Furthermore, according to another aspect of the present invention, there is provided a dielectric filter including a dielectric plate; a first electrode formed on a first main surface of the dielectric plate, parts of the first electrode being electrodeless; a second electrode formed on a second main surface of the dielectric plate, parts of the second electrode which are opposing the electrodeless parts of a first main surface being electrodeless; and a signal input unit and a signal output unit; wherein the electrodeless parts on the dielectric plate are formed as dielectric resonators; wherein the signal input unit and the signal output unit are disposed for coupling with the dielectric resonators to input and output signals; and wherein at least either one of the signal input unit and the signal output unit is formed on the dielectric plate as a linear conductor for coupling with the dielectric resonator, which is coupled with a particular part of the linear conductor so as to give band elimination filter characteristics to the linear conductor.

This structure permits attenuation of elements of the block band by band elimination filter characteristics of the linear conductor, which is a signal input unit or a signal output unit coupled with the dielectric resonator. Accordingly, when resonant frequency of a specified spurious mode is set within the block-band of the above-mentioned band elimination filter characteristics, responses of the spurious mode can selectively be suppressed. For example, it is possible to suppress even a spurious mode, which occurs on the lower-frequency band side than the resonant frequency of the main mode.

The linear conductor forming the low-band pass filter circuit may be disposed in a signal input unit and the linear conductor having the band elimination filter characteristics may be disposed in a signal output unit, so that spurious responses in a higher-frequency band than the resonant frequency of the main mode can be suppressed and furthermore, a specified spurious mode can selectively be suppressed.

In addition, when the dielectric resonator, to which the band elimination filter characteristics are given by coupling with the above linear conductor, is formed by the electrodeless parts having the both main surfaces of the dielectric plate therebetween, it is not necessary to mount a dielectric resonator as a separate component on the dielectric plate. Thus, formation of an electrode of a specified pattern on each main surface of a single dielectric plate permits formation of all the components including the dielectric resonator used as a main dielectric filter, the linear conductor used as a signal input unit and a signal output unit, and the dielectric resonator used for giving the band elimination filter characteristics to the linear conductor.

DESCRIPTION OF THE PREFERRED EMBODIMENTS

Referring now to FIG. 1, a description will be provided of a structure of a dielectric filter according to a first embodiment of the present invention.

Figure 1A:
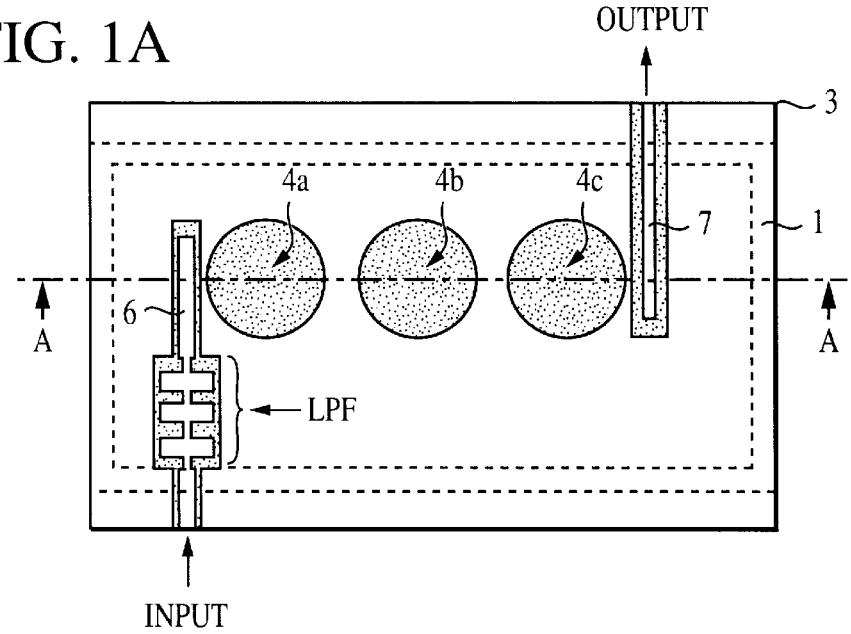
FIGS. 1A and 1B show structural views of a dielectric filter according to a first embodiment of the present invention.
Figure 1B:
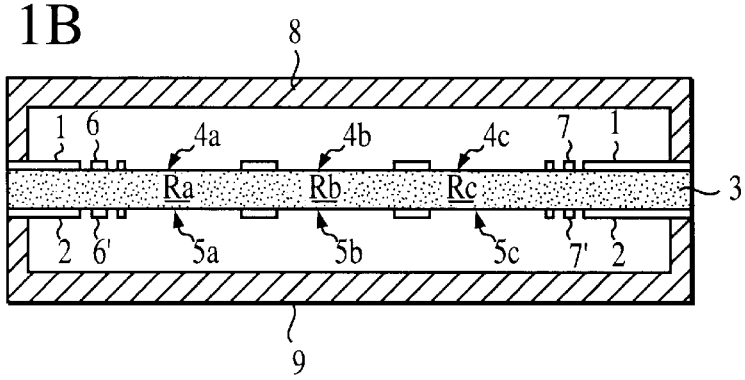

FIG. 1A shows a state in which the upper conductor plate of the dielectric filter is removed; FIG. 1B shows a section taken along the line A—A in FIG. 1A. In this figure, reference numeral 3 denotes a dielectric plate; on a first main surface of the plate, namely, on the upper surface of the plate shown in the figure, an electrode 1 is formed having electrodeless parts 4*a*, 4*b*, and 4*c*; and on a second main surface of the plate, namely, on the lower surface of the plate shown in the figure, an electrode 2 is formed having electrodeless parts 5*a*, 5*b*, and 5*c* opposing the electrodeless parts 4*a*, 4*b*, and 4*c*. The parts of the dielectric plate positioned between these electrodeless parts operate as TE010-mode dielectric resonators.

Linear conductors 6 and 7 are formed on the upper surface of the dielectric plate 3; and other linear conductors 6' and 7' are formed on the lower surface of the dielectric plate 3. Coplanar lines opposing on the both surfaces are formed by these linear conductors 6, 7, 6', 7' and the electrodes 1 and 2. Magnetic-field coupling occurs between the linear conductors 6 and 6' and a dielectric resonator Ra formed at the electrodeless parts 4*a* and 5*a*; and magnetic-field coupling occurs between the linear conductors 7 and 7' and a dielectric resonator Rc formed at the electrodeless parts 4*c* and 5*c*. The external end of the linear conductors 6 and 6' is used as a signal-input part, and the external end of the linear conductors 7 and 7' is used as a signal-output part. A low-band pass filter (LPF) circuit is respectively formed between the part of the linear conductors 6 and 6' coupling with the dielectric resonator Ra and the signal-input part, namely, on a particular part on the linear conductor. In this example, a capacitor is formed by an enlarged part of the line width of the linear conductor; and an inductor is formed by a narrowed part of the line width of the same. This structure permits formation of an LC low-band pass filter circuit.

As described above, the low-band pass filter circuit is formed at the signal-input part; and the filter is set to selectively eliminate signal having a frequency substantially equal to resonant frequency of TE010 mode, which is a main mode, or is set to a frequency higher than that of the main mode. In this arrangement, among signal elements input from the signal-input part, elements of a higher-frequency band than resonant frequency of the TE010 mode, which is the main mode, are blocked, even if the dielectric resonators Ra, Rb, and Rc are respectively in a state in which they can resonate in a spurious mode such as HE310 mode or TE110 mode, which has a higher resonant frequency than that of the TE010 mode as the main mode. As a result, signal elements of the spurious modes can be suppressed.

The coplanar line and the low-band pass filter are disposed on both main surfaces on the dielectric plate 3 in such a manner that the line and the filter thereon are mutually opposing. This arrangement prevents occurrence of spurious responses of a parallel plate mode, since the coplanar line and the low-band pass filter circuit are unlikely to couple with the parallel plate mode transmitting through the dielectric plate.

In the example described above, the low-band pass filter circuit is formed on the side of the signal-input part. In contrast, the low-band pass filter circuit may be formed on the side of the signal-output part. In this case, even if the resonant frequency of a spurious mode is higher than the resonant frequency of the TE010 mode as the main mode at the dielectric resonators, the low-band pass filter circuit blocks the signal elements of the spurious mode so that they may not be output.

Next, a description will be given of a structure of a dielectric filter according to a second embodiment of the present invention referring to FIG. 2.

Figure 2:
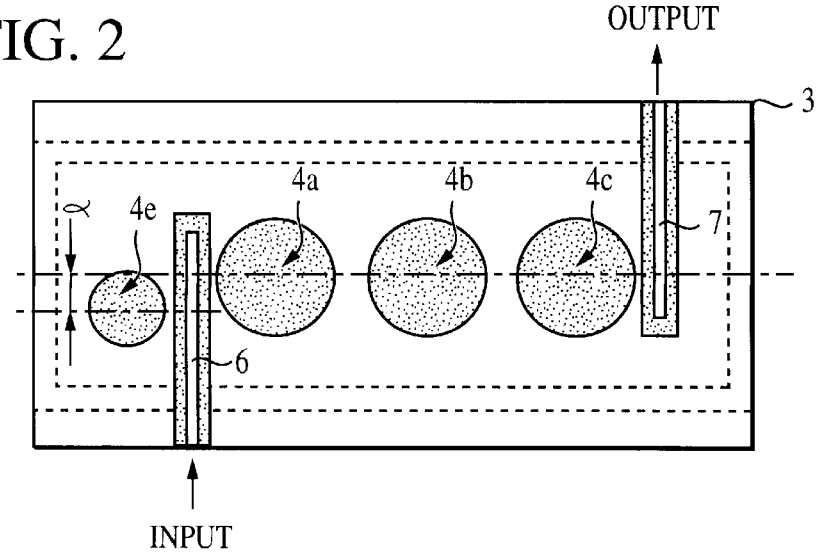
FIG. 2 shows a structural view of a dielectric filter according to a second embodiment of the present invention.

FIG. 2 shows a state in which the upper conductor plate of the dielectric filter is removed. In this figure, reference numeral 3 is a dielectric plate; on a first surface of the plate, namely, on the upper surface of the same shown in FIG. 2, an electrode is formed having electrodeless parts 4*a*, 4*b*, 4*c*, and 4*e*; and on a second surface of the plate, namely, on the lower surface of the same shown in FIG. 2, another electrode is formed having electrodeless parts opposing the electrodeless parts 4*a*, 4*b*, 4*c*, and 4*e*. Parts of the dielectric plate positioned between these electrodeless parts on both main surfaces acts as dielectric resonators of TE010 mode.

Linear conductors 6 and 7 are formed on the upper surface of the dielectric plate 3. These linear conductors 6, 7, and the electrode 1 comprise coplanar lines, respectively. Magnetic-field coupling occurs between the linear conductor 6 and the dielectric resonator Ra formed at the electrodeless part 4*a*; and furthermore, magnetic:-field coupling occurs between the linear conductor 7 and the dielectric resonator Rc formed at the electrodeless part. The external end of the linear conductor 6 is used as a signal-input part; and the external end of the linear conductor 7 is used as a signal-output part.

The dielectric resonator formed at the electrodeless part 4*e* of the dielectric plate 3 is disposed near a specified position of the linear conductor 6 so as to produce magnetic-field coupling between them. The resonant frequency of the dielectric resonator formed at the electrodeless part 4*e* is substantially equal to that of a spurious mode which is to be blocked. Reference character 1 denotes the distance between the coupling position of the dielectric resonator formed at the electrodeless part 4*a* with respect to the linear conductor 6 and the coupling position of the dielectric resonator formed at the electrodeless part 4*e* with respect to the linear conductor 6. The distance 1 is set to an odd multiple of $\lambda/4$, in which $\lambda$ represents the wavelength of a resonant frequency of a spurious mode which is to be blocked on the linear conductor 6. This arrangement permits signal elements of the spurious mode to be short-circuited equivalently at the two points which are at a distance of an odd multiple of $\lambda/4$ on the linear conductor 6, so as to produce band elimination filter characteristics which block the resonant frequency of the spurious mode.

Regarding the TE010 mode as the main mode, its resonant frequency differs from that of the dielectric resonator formed at the electrodeless part 4*e*, and in addition, the aforementioned distance 1 in this case is not an odd multiple of $\lambda/4$, in which $\lambda$ represents the wavelength of a resonant frequency of the TE010 mode on the linear conductor. As a result, the resonant frequency of the TE010 mode is not blocked so as to be transmitted through the linear conductor 6.

Accordingly, selective suppression of a specified spurious mode can be performed by appropriately determining the resonant frequency of the dielectric resonator formed at the electrodeless part 4*e* and the aforementioned distance 1.

In the dielectric resonator formed at the electrodeless part 4*e*, other than the TE010 mode, other resonant modes such as HE110 mode, HE210 or the like, are applicable. Furthermore, the main mode of the three dielectric resonators formed at the electrodeless parts 4*a*, 4*b*, and 4*c* is not limited to the TE010 mode, in which, for example, TE110 mode may be a main mode so that other spurious; modes can be suppressed by the above-mentioned band elimination filter characteristics.

In FIG. 2, the band elimination filter circuit is disposed on the side of the signal-input part. Similarly, it may be possible to dispose the band elimination filter circuit on the side of the signal-output part by coupling a specified part of the linear conductor 7 with another dielectric resonator.

Figure 3A:
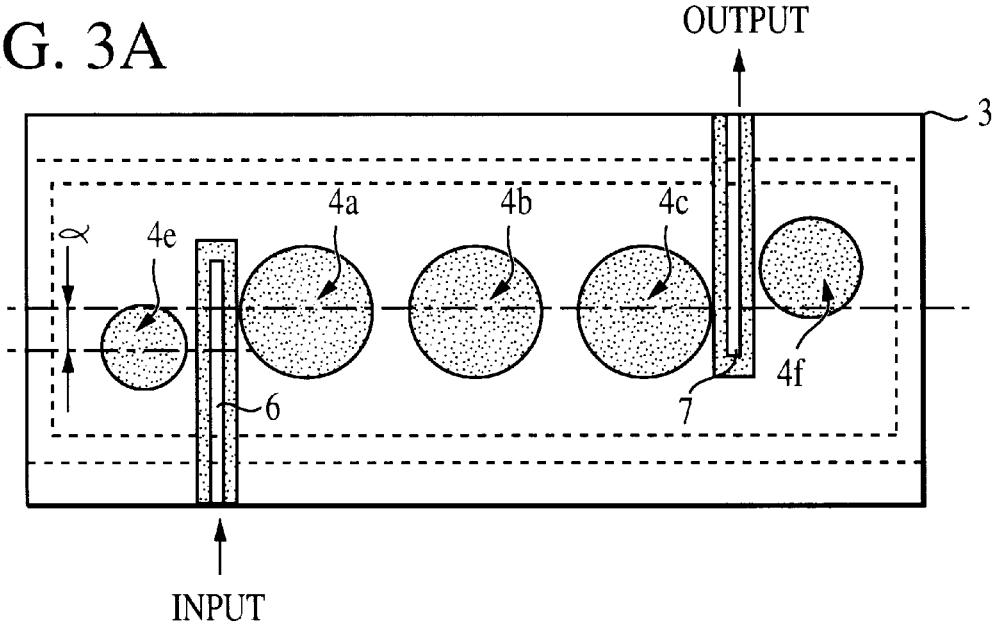
FIG. 3A and 3B show structural views of a dielectric filter according to a third embodiment of the present invention.
Figure 3B:
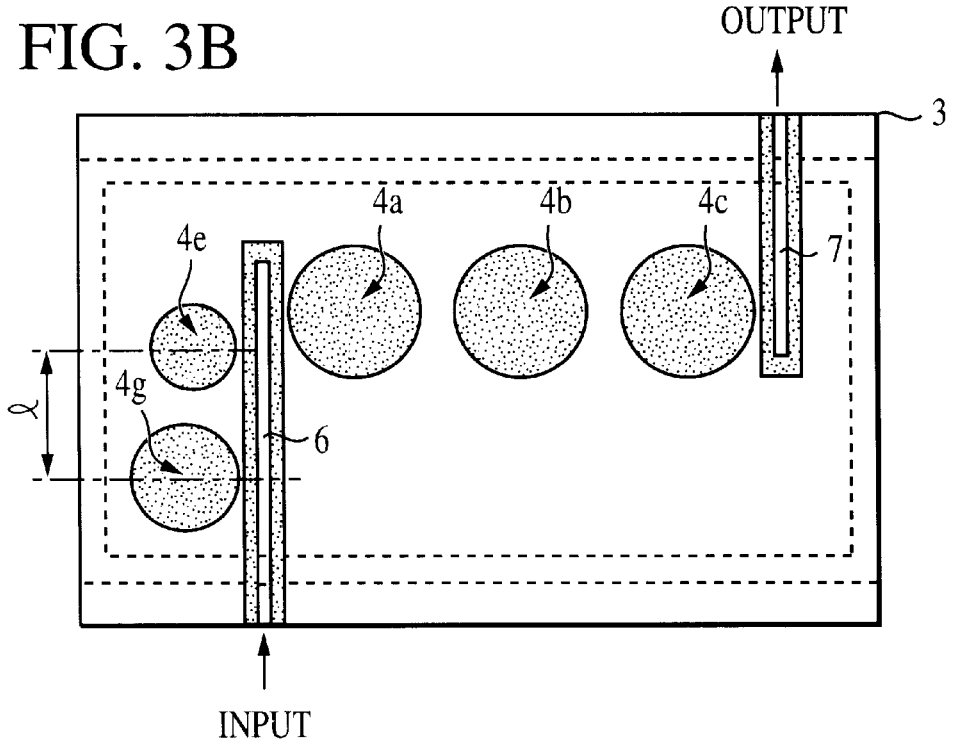

FIGS. 3A and 3B show structures of a dielectric resonator according to a third embodiment of the present invention. In the example of FIG. 3A, in addition to the side of the signal-input part, a dielectric resonator which is the same as the above-mentioned one is also disposed on the side of the signal-output part so as to respectively give band elimination filter characteristics.

In this case, at least two spurious modes can selectively be suppressed when blocking in a different frequency band is respectively performed by each band elimination filter circuit of the signal-input part and the signal-output part.

In the example of FIG. 3B, the linear conductor 6 is coupled with two dielectric resonators formed at the electrodeless parts 4*e* and 4*g*. When the distance 1 between respective coupling points of these two dielectric resonators with the linear conductor is set to an odd multiple of $\lambda/4$, in which $\lambda$ represents the wavelength of a frequency which is to be blocked. This arrangement permits the two dielectric resonators formed at the electrodeless parts 4*e* and 4*g* and the linear conductor 6 to comprise a band elimination filter circuit.

In FIG. 3B, the distance between the coupling position of the dielectric resonator formed at the electrodeless part 4*a* with respect to the linear conductor 6 and the coupling position of the dielectric resonator formed at the electrodeless part 4*e* with respect to the linear conductor 6 may be set to an odd multiple of ¼ the wavelength of the frequency which is to be blocked. This permits formation of a band elimination filter circuit comprising two resonators.

In the example of FIG. 3B, the band elimination filter circuit is disposed on the side of the signal-input part. In contrast, on the side of the signal-output part, the band elimination filter circuit comprising two resonators may be disposed. In addition, the number of dielectric resonators for comprising the band elimination filter circuit is not limited to two, and it may be three or more.

Figure 4:
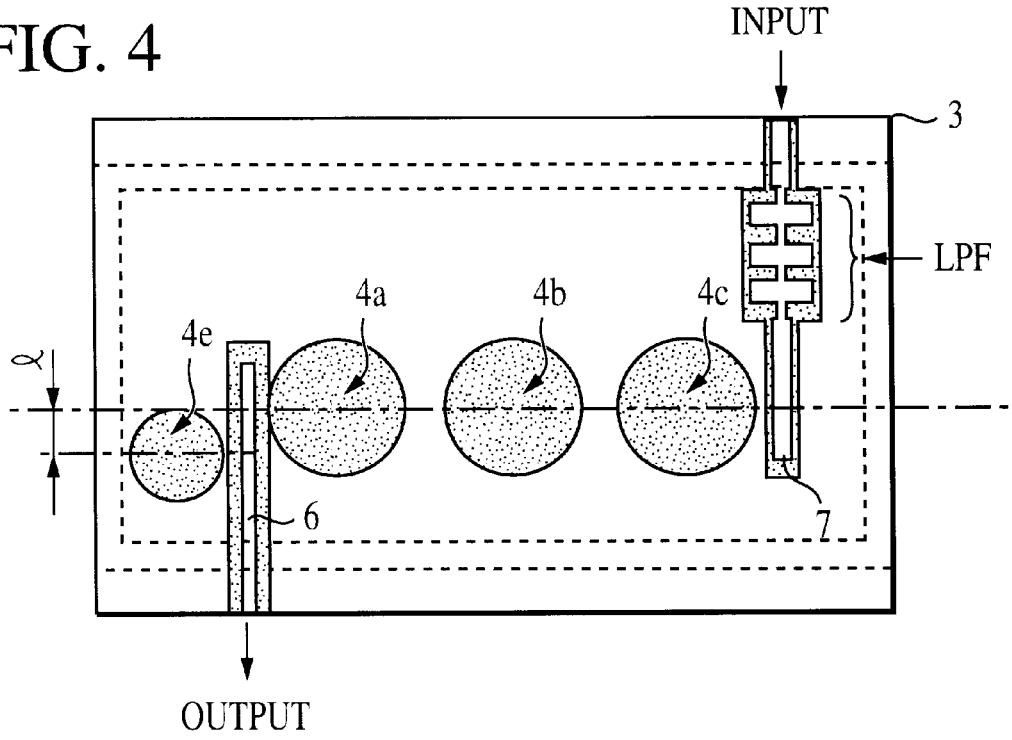
FIG. 4 shows a structural view of a dielectric filter according to a fourth embodiment of the present invention.

FIG. 4 shows a structural example of a dielectric filter according to a fourth embodiment. In the dielectric filter, a dielectric resonator is formed at the electrodeless part 4*e* so as to couple with the linear conductor 6 at a specified part; and in addition, a low-band pass filter circuit is formed on a particular part of the linear conductor 7. As is the case with FIG. 1A, a linear conductor and a low-band pass filter circuit which correspond to the linear conductor 7 and the low-band pass filter circuit on the upper surface of a dielectric plate 3 may be disposed on the lower surface of the same, as required, in such a manner that both of them are mutually opposing through the plate.

Spurious responses on the higher frequency band side than a resonant frequency of the maid mode can be suppressed by determining a block frequency of the low-band pass filter circuit; and spurious responses on the lower frequency band side than a resonant frequency of the main mode can selectively be suppressed by determining a block band of the low-band pass filter circuit.

When the resonant frequency of a spurious response higher than the resonant frequency of the maid mode is intensively suppressed, suppression of the spurious response by the band elimination filter circuit may be possible.

Figure 5:
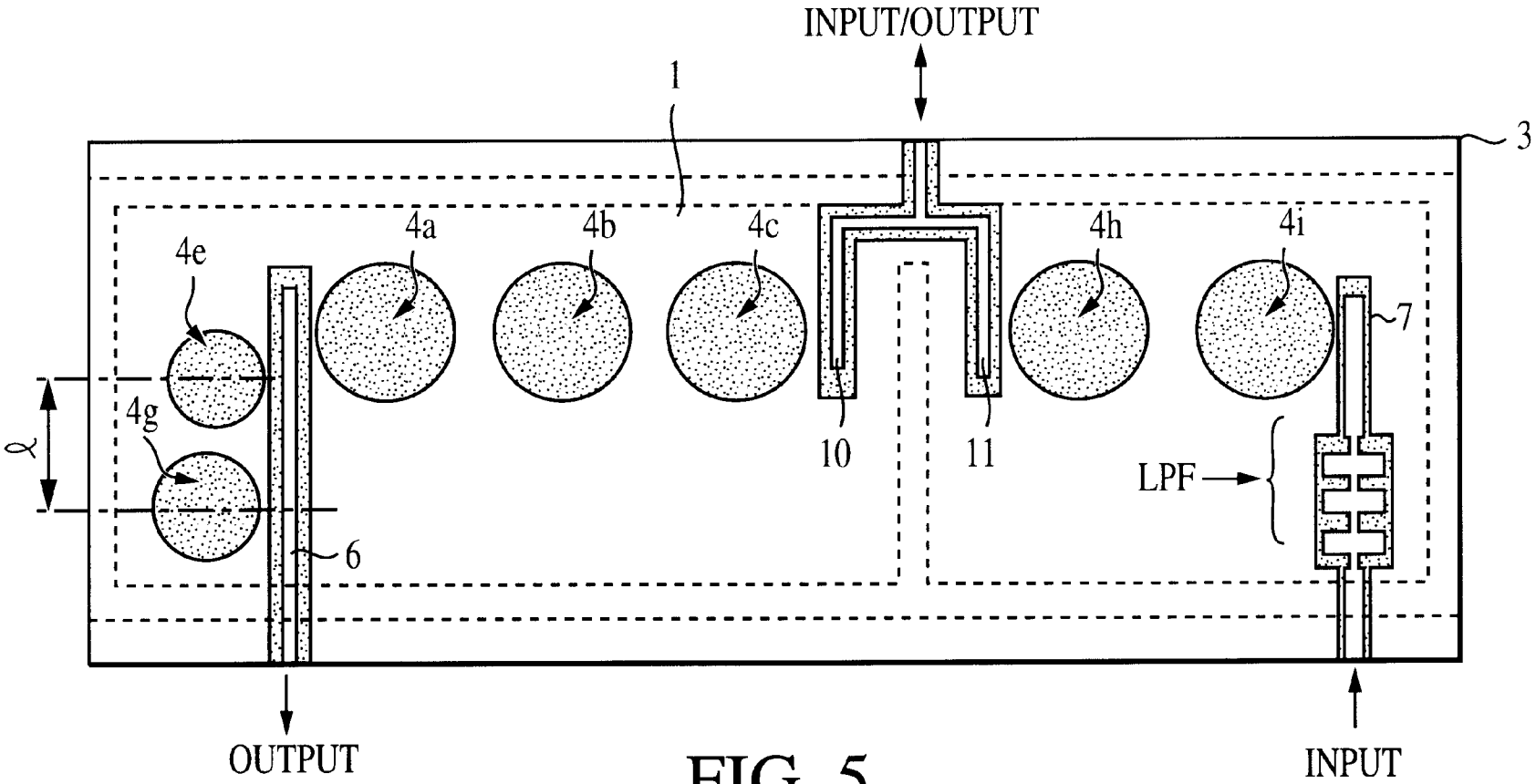
FIG. 5 shows a structural view of a transmission reception shared unit employed in the present invention.

Referring now to FIG. 5, a description will be provided of a structure of a transmission-reception shared unit according to a fifth embodiment of the present invention.

FIG. 5 is a plan view of the unit in a state in which the upper conductor plate is removed. The entire basic structure of the unit is the same as the dielectric filter having 2 ports described above. In FIG. 5, on the tipper surface of a dielectric plate 3, an electrode is formed having seven electrodeless parts indicated by 4*a*, 4*b*, 4*c*, 4*h*, 4*i*, 4*e*, and 4*g*; and on the lower surface of the dielectric plate 3, another electrode is formed having electrodes parts opposing the electrodeless parts on the upper surface. This arrangement allows seven dielectric resonators to be formed on the single dielectric plate 3. Linear conductors 6, 7, 10, and 11 are formed on the upper surface of the dielectric plate 3 so as to form respective coplanar lines by these linear conductors and the electrode 1. The linear conductors 10 and 11 are formed by branching at a specified point. Magnetic-field coupling occurs between respective specified parts of the linear conductor 6 and the three dielectric resonators formed at the electrodeless parts 4*a*, 4*e*, and 4*g*, respectively; and in addition, magnetic-field coupling occurs between a specified part of the linear conductor 7 and the dielectric resonator formed at the electrodeless part 4*i*. Furthermore, magnetic-field coupling occurs between the linear conductors 10 and 11 and the dielectric resonators formed at the electrodeless parts 4*c* and 4*h*, respectively.

The relationship between the linear conductor 6 and the coupling three dielectric resonators is the same as that shown in FIG. 3B, in which the linear conductor 6 has band elimination filter characteristics. At a specified position of the linear conductor 7 is formed a low-band pass filter circuit LPF which is the same as that shown in FIG. 1A.

The three dielectric resonators formed at the electrodeless parts 4*a*, 4*b*, and 4*c* are used for a receiving filter; and the two dielectric resonators formed at the electrodeless parts 4*h* and 4*i* are used for a transmitting filter.

The electrical length from the equivalent short-circuit surface of the dielectric resonator formed at the electrodeless part 4*c* to the branching point of the linear conductors 10 and 11 is set to an odd multiple of ¼ the wavelength of a transmitting frequency on the linear conductor; and furthermore, the electrical length from the equivalent short-circuit surface of the dielectric resonator formed at the electrodeless part 4*h* to the branching point of the same is set to an odd multiple of ¼ the wavelength of a receiving frequency on the linear conductor.

This structure permits both the transmitting filter and the receiving filter to suppress a specified spurious mode and also to branch into transmitting signals and receiving signals.

Figure 6:
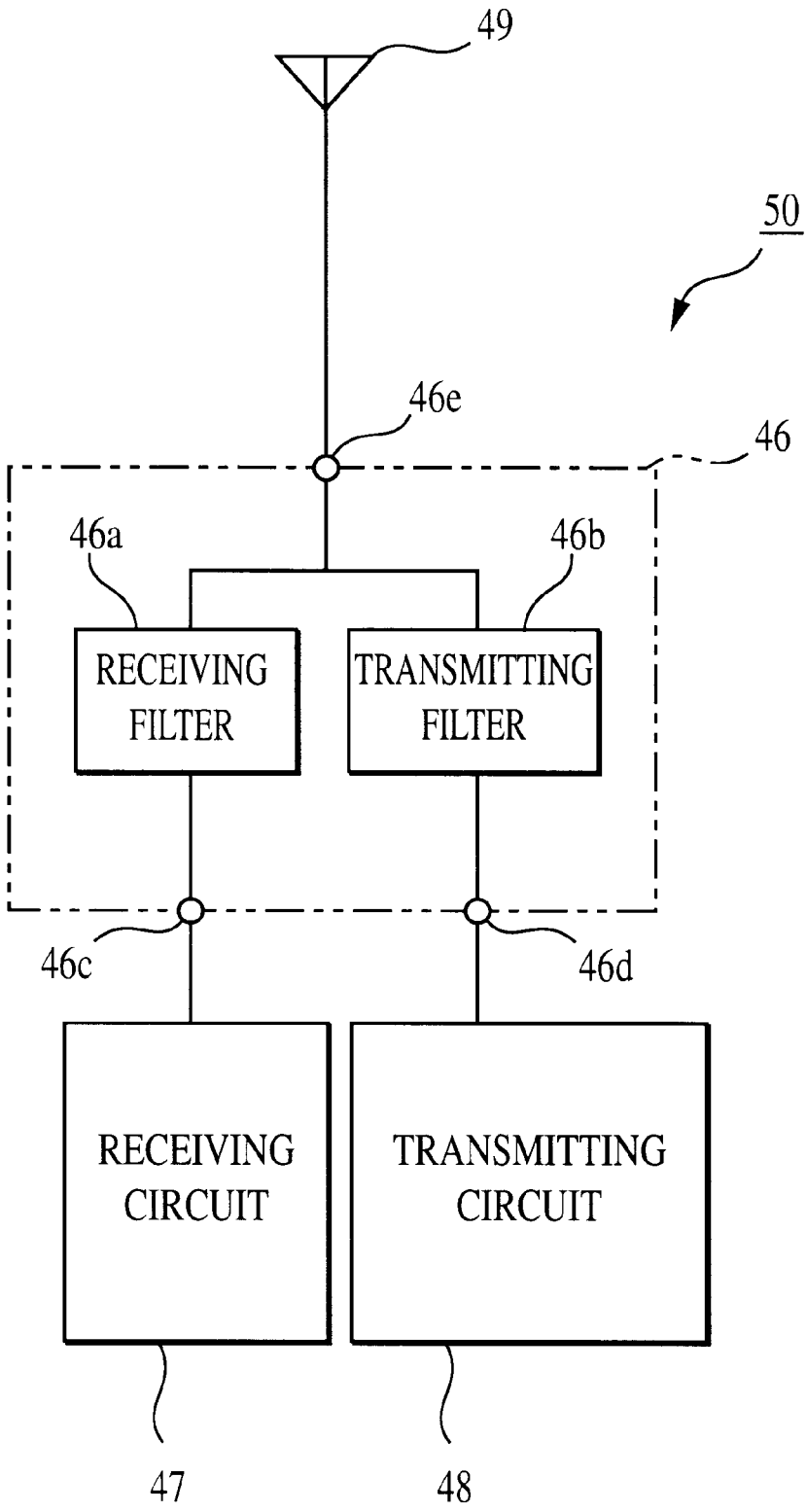
FIG. 6 shows a block diagram illustrating a structure of a communication device employed in the present invention.
Figure 7A:
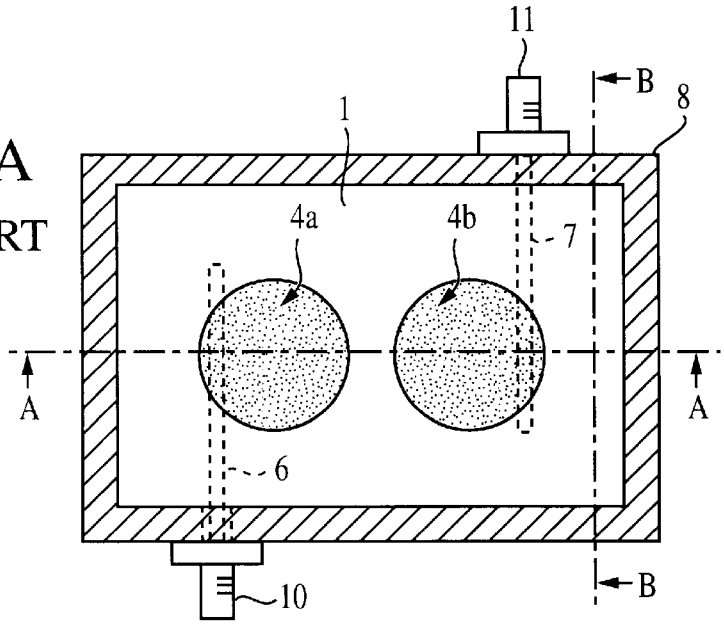
FIG. 7A PRIOR ART
FIGS. 7A, 7B, and 7C show a structural example of a conventional dielectric filter.
Figure 7B:
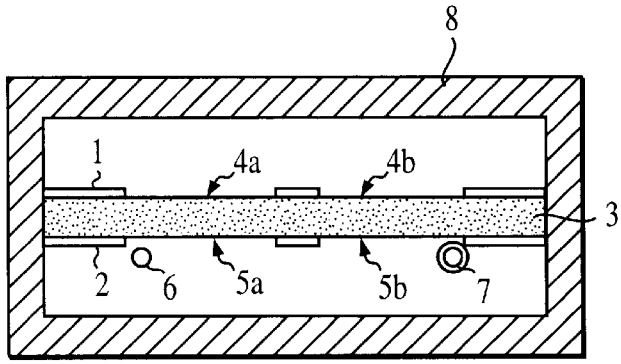
FIG. 7B PRIOR ART
Figure 7C:
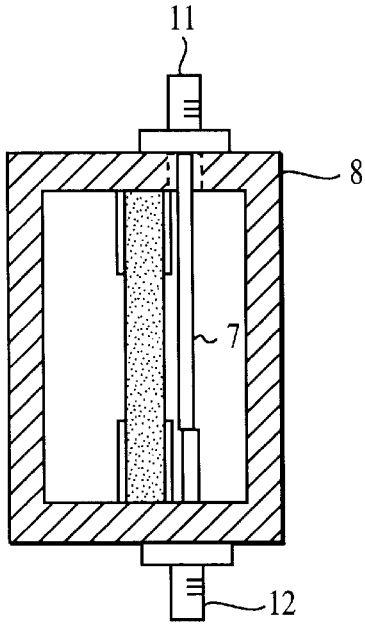
FIG. 7C PRIOR ART
Figure 8:
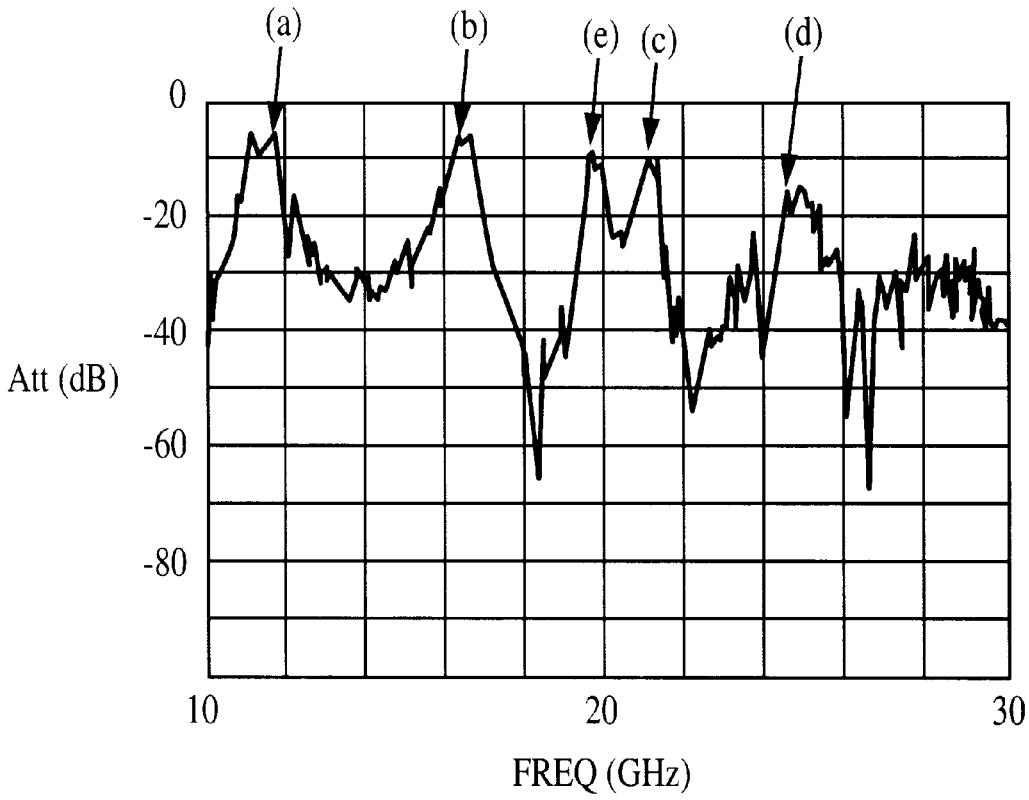
FIG. 8 PRIOR ART
FIG. 8 shows attenuation characteristics of the conventional dielectric filter.
Figure 9A:
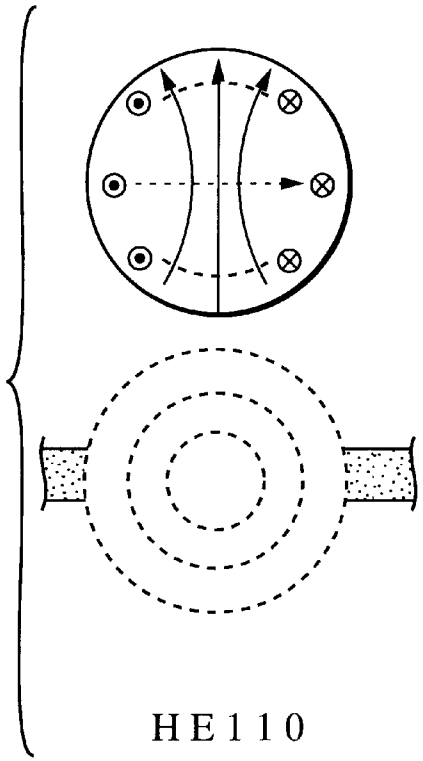
FIGS. 9A to 9E show examples of electromagnetic field distributions of various resonant modes.
Figure 9B:
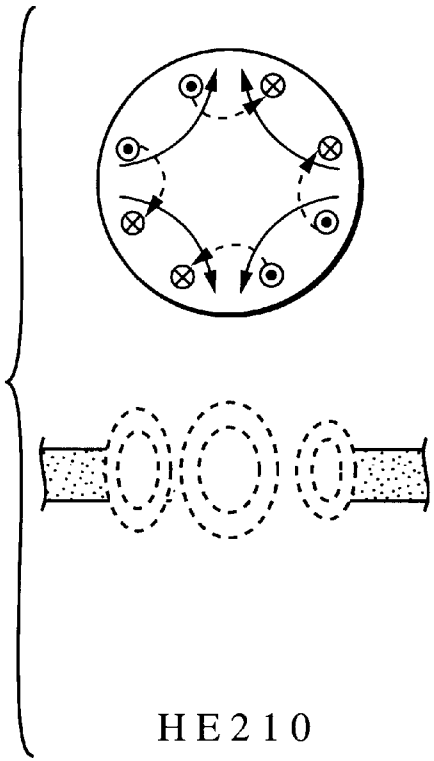
Figure 9C:
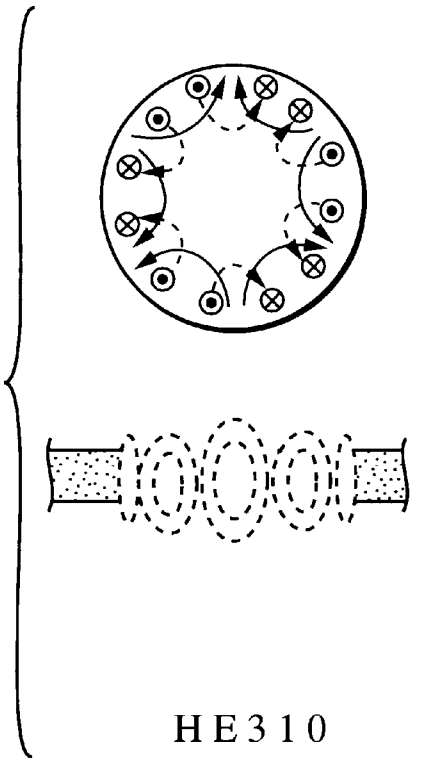
Figure 9E:
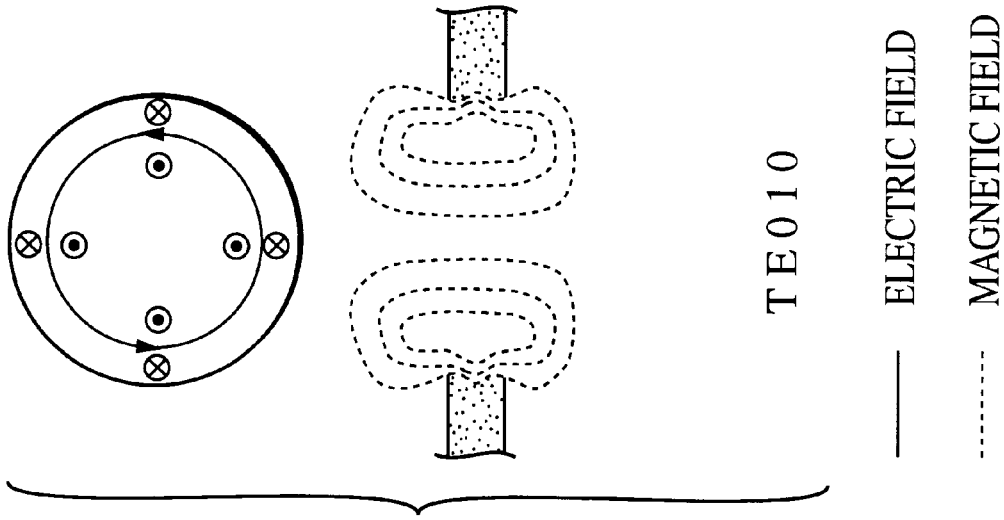
Figure 9D:
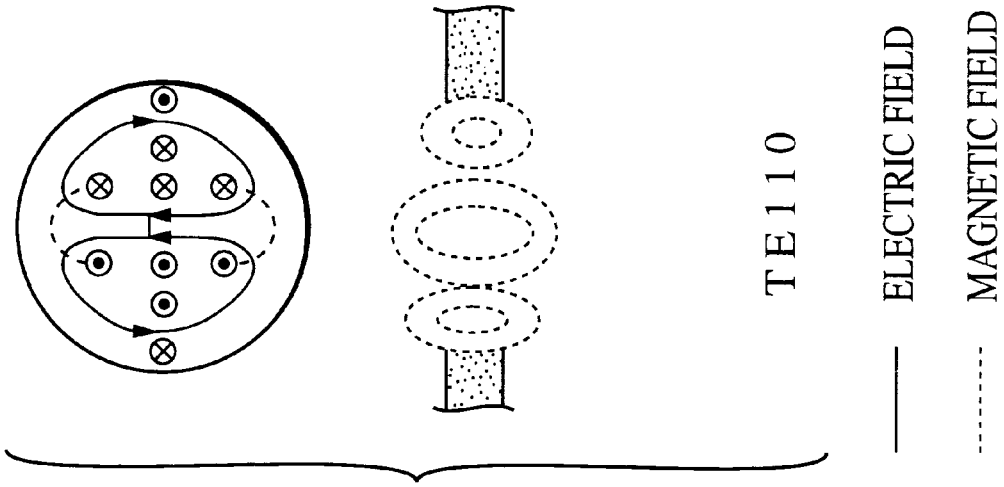

FIG. 6 shows a block diagram of a structure of a communication device according to a sixth embodiment: of the present invention.

In the communication device shown in FIG. 6, the aforementioned transmission-reception shared unit is used as an antenna-shared unit. In the arrangement of the communication device, the receiving filter is indicated by reference character 46*a*; the transmitting filter is indicated by reference character 46*b*; and the antenna-shared unit is indicated by reference character 46. As shown in this figure, a communication device 50 overall comprises a receiving circuit 47 connected to a receiving signal output port 46C of the antenna-shared unit 46; a transmitting circuit 48 connected to a transmitting signal input port 46*d* of the same; and an antenna 49 connected to an I/O port 46*e* of the same.

As described above, use of such an antenna-shared unit having good spurious characteristics and good branching characteristics permits a small and highly efficient communication device to be produced.

Although FIG. 6 shows an example of a communication device incorporating the transmission-reception shared unit employed in the present invention, the aforementioned various dielectric filters can be disposed in the high-frequency circuit section of the communication device. This permits formation of a communication device having a high-frequency circuit free from spurious influence.

According to the present invention, there is provided a dielectric filter comprising a plurality of dielectric resonators formed on a dielectric plate, in which input and output of spurious modes can be controlled so that spurious responses can be suppressed. This arrangement improves attenuation characteristics of a dielectric filter, thereby leading to production of a dielectric filter having good attenuation characteristics, a transmission-reception shared unit having good branching characteristics and a communication device having high efficiency.

The present invention permits a specified spurious mode to be selectively suppressed so that influence of the spurious mode can effectively be reduced.

What is claimed is:

1. A dielectric filter comprising:

a dielectric plate;

a first electrode formed on a first main surface of the dielectric plate, the first electrode having a first opening;

a second electrode formed on a second main surface of the dielectric plate, the second electrode having a second opening being opposite to said first opening;

a signal input coupled to said dielectric resonator;

a signal output coupled to said dielectric resonator;

wherein at least one of the signal input means and the signal output means is formed on the dielectric plate as a linear conductor for coupling with the dielectric resonators and for forming a low-band pass filter circuit.

2. A dielectric filter comprising:

a dielectric plate;

a first electrode formed on a first main surface of the dielectric plate, the first electrode having a first opening;

a second electrode formed on a second main surface of the dielectric plate, the second electrode having a second opening opposing said first opening; and signal input being coupled to said resonator;

signal output being coupled to said resonator;

wherein the signal input means and the signal output means are disposed for coupling with the dielectric resonators to input and output signals; and wherein at least one of the signal input means and the signal output means is formed on the dielectric plate as a linear conductor for coupling with the dielectric resonator, which is coupled with a particular part of the linear conductor so as to give band elimination filter characteristics to the linear conductor.

3. A dielectric filter comprising:

a dielectric plate;

a first electrode formed on a first main surface of the dielectric plate, the first electrode having a first opening;

a second electrode formed on a second main surface of the dielectric plate, the second electrode having a second opening opposed to said first opening;

a signal input being coupled to said resonator;

a signal output being coupled to said resonator;

wherein the signal input means and the signal output means are disposed for coupling with the dielectric resonators to input and output signals;

wherein one of the signal input means and the signal output means is formed on the dielectric plate as a linear conductor for coupling with the dielectric resonator and forming a low-band pass filter circuit; and wherein the other one of the signal input means and the signal output means is formed on the dielectric plate as a linear conductor for coupling with the dielectric resonator, which is coupled with a particular part of the linear conductor so as to give band elimination filter characteristics to the linear conductor.

4. A dielectric filter according to claim 2, wherein a plurality of the dielectric resonators are formed by disposing an electrode on a first main surface and a second main surface of the dielectric plate so that some of the dielectric resonators are dielectric resonators for coupling with a particular part of the linear conductor.

5. A transmission-reception shared unit comprising the dielectric filter according to claim 1, wherein the dielectric filter is used as at least one of a transmitting filter and a receiving filter; the transmitting filter is disposed between a transmitting signal input port and an I/O port; and the receiving filter is disposed between a receiving signal output port and the I/O port.

6. A communication device comprising the dielectric filter according to claim 1, in a high-frequency circuit section thereof.

7. A communication device comprising the transmission-reception shared unit according to claim 5, in a high-frequency circuit section thereof.

* * * * *